United States Patent [19]

Eakes

[11] 4,050,368

[45] Sept. 27, 1977

[54] EXHAUST SYSTEM FOR INDUSTRIAL PROCESSES

[75] Inventor: Marion L. Eakes, Greensboro, N.C.

[73] Assignee: Marion L. Eakes Co., Greensboro, N.C.

[21] Appl. No.: 645,997

[22] Filed: Jan. 2, 1976

[51] Int. Cl.[2] ..... F23J 11/00

[52] U.S. Cl. ..... 98/115 LH; 98/36; 266/158; 266/159; 55/DIG. 18; 55/385 A

[58] Field of Search ..... 98/115 LH, 115 K, 115 R, 98/36; 204/247; 202/254, 263; 104/52; 266/158, 159; 55/DIG. 18, 385 A, DIG. 29

[56] References Cited

U.S. PATENT DOCUMENTS

| | | | |
|---|---|---|---|
| 3,303,839 | 2/1967 | Tavan | 98/115 K |
| 3,397,631 | 8/1968 | Simmons | 98/36 |
| 3,425,335 | 2/1969 | Black | 98/115 LH |
| 3,708,414 | 1/1973 | Laube | 98/36 X |
| 3,800,689 | 4/1974 | Brown | 98/115 K |

*Primary Examiner*—Ronald C. Capossela

[57] ABSTRACT

A textile or other industrial machine, of the type where one or a plurality of operations generate a gaseous discharge at a work station, is provided with at least one wall leaving at least one open side and includes an exhaust hood on the top which communicates with the air space above the work station. A first fan communicates with the exhaust hood to withdraw smoke, fumes, vapors and steam from the air space and deliver it to the outside. A second fan draws in fresh, unconditioned outside air and delivers it to a delivery nozzle extending along the front edge of a work table in said work station. An air curtain is thus formed between the delivery nozzle and the aforementioned exhaust hood, whereby the smoke, fumes, vapors and steam are confined within the air space above the work table until withdrawn through the exhaust hood. Further the delivery nozzle provides a surce of fresh air to replace the air withdrawn so that the conditioned air in the workroom surrounding the textile machine is substantially unaffected.

In a preferred embodiment, a portion of the exhausted air is recirculated through the air space above the work table prior to being treated by some type of cleaning apparatus, so that the volume of air per unit time passing through the cleaning operation is reduced. Further the amount of outside air drawn into the system is kept to a minimum to prevent air turbulence in the air curtain and rapid temperature changes in and around the work table, which might lead to a fogging problem.

In another embodiment, the air delivered to the delivery nozzle at said work table is removed as exhaust air from another operation, such as a drying operation, rather than from the outside, so that the total amount of air drawn in from the outside is minimized.

14 Claims, 5 Drawing Figures

EXHAUST SYSTEM FOR INDUSTRIAL PROCESSES

BACKGROUND OF THE INVENTION

In certain industrial processes, such as the drawing and crimping of synthetic yarn tow and the like, and in other similar industrial processes, a substantial amount of steam, vapors, smoke, and or oil fumes, hereinafter sometimes referred to as "exhaust gases," are generated. It is of course necessary to collect these gases and not let them escape into the atmosphere of the work room surrounding the machines. It has become commonplace to use an exhaust hood over such work areas, which, while substantially removing the contaminated exhaust gases, also draws in a tremendous amount of the conditioned air from the work room surrounding the textile machines. This conditioned air (either heated in winter or cooled in summer) is expensive to treat, and therefore costs of conditioning air can be minimized if the exhaust gases can be removed without, at the same time, losing the conditioned air into the exhaust hood.

There are several relatively elaborate and expensive schemes and systems for controlling these exhaust gases, as noted in the prior art U.S. Pat. to Danieli No. 3,834,293; to Laube U.S. Pat. No. 3,708,414; and to Tavan U.S. Pat. No. 3,303,839. While the apparatus described in each of these patents is satisfactory for its own purpose, they do not substantially solve the problem described hereinabove. For example, the Danieli patent is illustrative of an extremely large and elaborate system for completely encircling a smelting furnace work area with a screen of compressed air from floor to ceiling. Such an air screen, while disposing of the gases from the smelting furnace in a suitable manner, will also tend to remove a substantial amount of treated air from the room surrounding the furnace. In work areas where smelting occurs this may be immaterial, but in air conditioned work rooms (heated or cooled), it becomes very important.

In the Laube patent, an air curtain which also completely surrounds the work station is generated in an inclined path over a considerable distance, again to remove exhaust gases from an electrolytic melt vessel. The Tavan patent is directed to a cooking unit which includes a vertical air curtain completely surrounding the unit, however the air supplied is drawn from the room surrounding the cooking unit, passed through the air curtain, and collected where it is filtered and then returned into the room.

SUMMARY OF THE PRESENT INVENTION

The present invention, to the contrary, is directed to an apparatus wherein a work station is enclosed on three sides and the top and a gentle flowing, vertical curtain of air is generated along the open side of the work area, with at least partially fresh outside air being introduced through a nozzle at the lower side toward the exhaust inlet at the top. By providing a gentle flow of air in a vertical path along the open side of the enclosure, the gases within are confined and kept separate from the environment surrounding the work area, and are caused to exit only through the exhaust hood without working their way into the atmosphere. Further, fresh air is introduced below the work area and directed toward the exhaust hood to replace the air withdrawn, so that the conditioned room air surrounding the textile machine is relatively unaffected, thereby minimizing additional expense to the heating or air conditioning equipment.

In a preferred embodiment, a portion of the dirty exhaust air is rerouted and introduced through a perforated rear wall of the enclosure surrounding the work table to aid in collecting the exhaust gases and delivering them into the exhaust hood. Such an embodiment reduces the amount of fresh air necessary to form the air curtain. It has been found that the most desirable air curtain is generated when the air input is only approximately 33% of the exhaust. This prevents air turbulence in the curtain as well as eddy currents extending outwardly therefrom. Since the air curtain or the air introduced into the work area does not necessarily have to be clean air, the return exhaust air may therefore be routed through the rear of the enclosure to provide sufficient input to keep from disturbing the atmosphere surrounding the work area, without deleteriously affecting the air curtain.

In another embodiment, the returning or rerouted dirty exhaust gases are divided, and a portion are introduced close to and toward the exhaust inlet. The small air jet thus generated tends to condense and improve the configuration of the air curtain even further.

In yet another embodiment, the primary work area, where the contaminated exhaust gases are generated, is provided with an exhaust hood as in the other embodiments. However, the incoming fresh air is first directed to another or secondary work area or operational area within the plant, such as a dryer where outside make-up air is also used. A portion of the exhaust air from the dryer is delivered to the primary work area to be introduced through a delivery nozzle or manifold below the work table which forms the air curtain. Another portion of the exhaust air from the dryer is passed in heat exchange relationship with the incoming outside air to preheat the air before introduction to the dryer so that the incoming air does not have to be heated as much by the dryer. As the dryer exhaust air passes from the heat exchanger it then becomes another portion of the air input to the primary work area either through the delivery nozzle, or through a perforated rear or side wall, as described in the preferred embodiment. With this embodiment, the ventilation system of the primary work area is even further and more economically put to use.

It is therefore an object of the present invention to provide an improved exhaust system for industrial processes which generate substantial amounts of contaminated exhaust gases.

It is another object of the present invention to provide an improved exhaust system of the type described which generates a substantially vertical air curtain to confine the exhaust gases and separate such gases from the atmosphere of the work room surrounding the industrial machine.

It is a further object of the present invention to provide an exhaust system of the type described in which the air flow within the air curtain itself is improved to minimize turbulence and eddy currents.

It is yet another object of the present invention to provide an exhaust system of the type described in which a portion of the exhaust air is recirculated through the work area to minimize the amount of fresh air drawn in as well as to improve the air curtain itself.

Other objects and a fuller understanding of the invention will become apparent after reading the following detailed description of a preferred embodiment in view of the accompanying drawings in which.

DETAILED DESCRIPTION OF A PREFERRED EMBODIMENT

Figure 1:
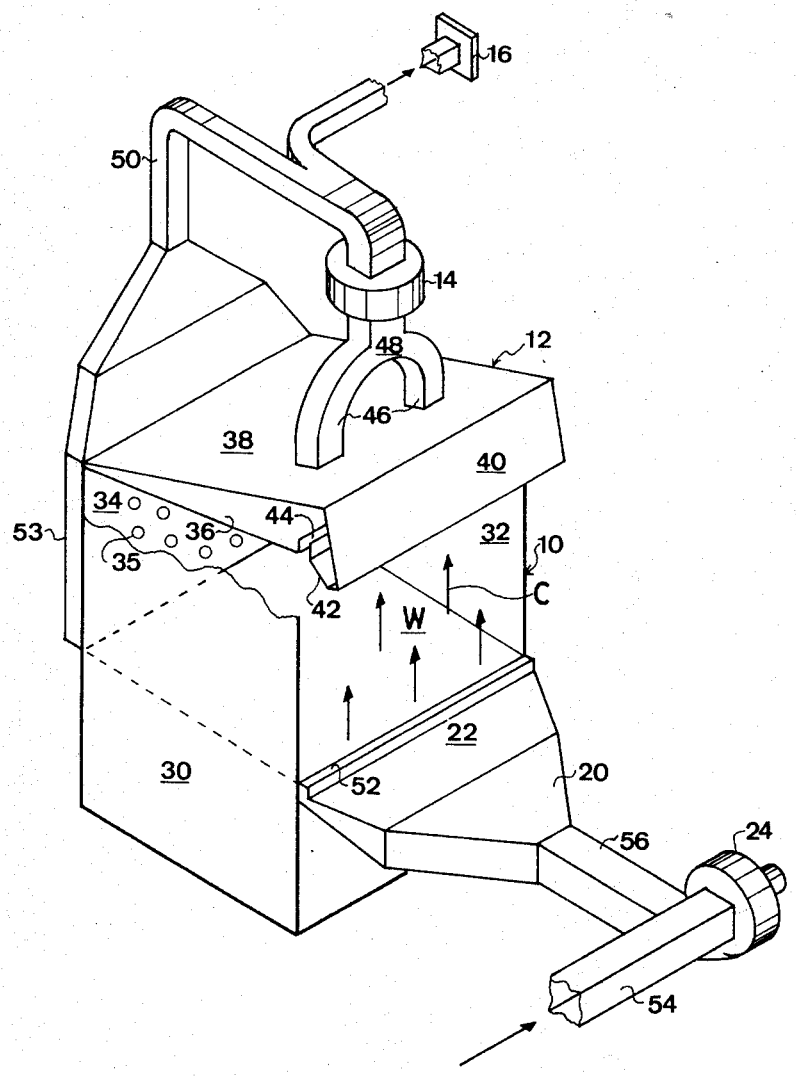
FIG. 1 is a perspective view of a preferred form of the apparatus according to the present invention as installed on a textile apparatus with the upper portion of the side wall removed for the sake of clarity.
Figure 2:
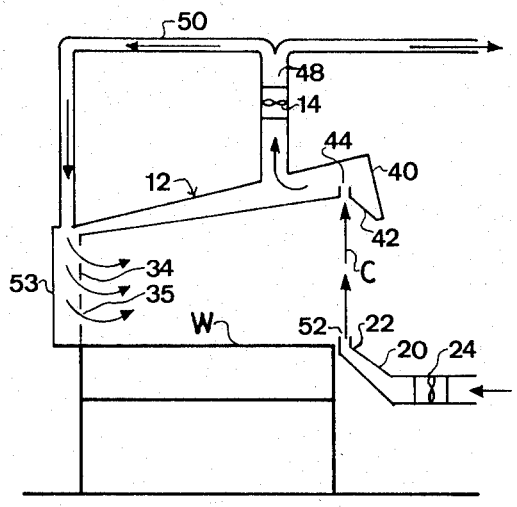
FIG. 2 is a sectional view taken through an apparatus similar to that shown in FIG. 1, and showing schematically the air flow path of the air curtain in relation to the apparatus.

Turning now to the drawings, and first of all to FIGS. 1 and 2, there is schematically illustrated an industrial machine comprising a work table W on or at which some type of manufacturing process occurs which generates smoke, steam,fumes, or other gaseous vapors which must be collected from the area above work table W before they are allowed to dissipate into the atmosphere surrounding the work area. According to the invention, the work table W is surrounded on three sides and the top by an enclosure 10. An exhaust hood 12 includes an inlet opening 44 therein in cooperation with and extending along the front or open side of the area above the work table W. A first exhaust fan 14 draws the exhaust gases from the work area and exhausts such gases to the atmosphere, preferably through some type of suitable pollution abatement means 16.

In cooperation with the front edge of the work table W, a fresh air inlet means 20 is provided having a delivery nozzle 22 extending generally parallel to and slightly below the front edge of the work table W. A second fan 24 pulls in air from an outside source, such as the outdoors or from other operations (FIG. 5), and delivers the outside air through the aforementioned nozzle 22.

The inlet 44 for exhaust gases to enter exhaust hood 12 is positioned substantially vertically above the nozzle 22, so the the incoming air forms a generally vertical air curtain C between the fresh air inlet means 20 and the exhaust hood 12. Substantially all of the outside air introduced into the air curtain C is thus caused to be drawn directly into the exhaust hood, rather than escaping into the conditioned air within the environment surrounding the industrial machine within the work room. A portion of the exhausted air is returned to the area above work table W by means of a return duct 50, which introduces the return dirty exhaust air through a perforated rear wall 34.

The air curtain C described hereinabove thus forms a barrier extending between the inlet means and the exhaust means confining the exhaust gases within the area immediately above the work table and within the enclosure 10 until withdrawn through the exhaust hood. Further, the outside air and the return dirty exhaust air provided through air inlet means 20 and rear wall 34 provide a source of replacement air to replenish the air withdrawn from enclosure 10, so that the conditioned air within the work room surrounding the textile machine is substantially unaffected.

Looking now more specifically at the invention at work table W or within the enclosure 10, any number of industrial processes might occur, such as the drawing and crimping of synthetic tow for yarn, and other operations which are substantially automatic and which generate substantial amounts of smoke, steam, fumes or other gaseous vapors which must be withdrawn and removed. The invention is limited only in that such operations are susceptible to being enclosed on three sides and the top, so that it is not required that the operator move all around the process during the working operation thereof.

In this environment then, the invention, as hereinbefore stated, includes an enclosure 10 which surrounds work table W. More specifically, enclosure 10 includes side walls 30, 32, a perforated rear wall 34, and a top wall 36. An upper exhaust hood 12 uses the top wall 36 as a base portion thereof and includes a hood 38 extending across the top thereof and outwardly from the front, where it bends down to a front lip 40. A flange 42 extends rearwardly and upwardly from front lip 40 and leaves a gap or inlet 44 between lip 42 and top wall 36 which forms the entrance to the exhaust hood as described hereinabove. This inlet 44 extends along the upper front edge of the work area above work table W and admits exhaust gases, as well as the air curtain C, into the exhaust hood 12.

Preferably, a pair of ducts 46 extend upwardly from the roof 38 of exhaust hood 12 and merge into a common duct 48 in which first fan 14 is placed for the purpose of removing the exhaust gases to the outside. After leaving first fan 14, in the preferred embodiment, the common duct 48 is branched, so that a return duct 50 extends downwardly toward a rear plenum 53 which encloses rear wall 34. The dirty gases withdrawn and returned then are introduced to the work chamber through perforations 35 in rear wall 34.

The air inlet or delivery means 20 includes a second fan 24, which is connected by means of appropriate ductwork 54 to an outside source of fresh air and draws such outside air to the system. Fan 24 delivers the outside air through duct 56, which is enlarged according to conventional sheet metal working techniques to delivery nozzle 22 having an outlet slit 52 positioned slightly below and extending in generally parallel relation to the front edge of work table W. It should be noted that inlet 44 of exhaust hood 12 should be located immediately above outlet 52 of nozzle 22, so that the air emitted from nozzle 22 will all tend to rise and be collected through inlet 44. If inlet 44 is substantially moved horizontally from its position, some or most of the air in air curtain C will not be collected because, when heated, such air will tend to rise vertically, rather than continue along the inclined path, even in the presence of a draft. The result would be that the air curtain becomes turbulent, and eddy currents are formed, which deleteriously affect the formation of the air curtain and the operation of the invention.

In the embodiment illustrated in FIGS. 1 and 2, fans 14, 24 and duct 50 are preferably so balanced as to draw in through nozzle 22 approximately one-third of the volume of air being exhausted through exhaust inlet 44. This insures that the air curtain C, thus formed, will be well defined, and that some negative pressure wil be exerted on air immediately upon exiting from nozzle 22 to direct it toward the exhaust inlet 44.

Such an arrangement prevents the inadvertent withdrawal of treated air from the work room, which has previously been either heated during the winter or cooled during the summer. The equipment for heating and cooling air for the work room is expensive, and a substantial savings can be effected by using the invention as described hereinabove. This savings comes about because of the reduction of treated air withdrawn from the work room, thereby reducing the capacity and use of the expensive conditioning equipment.

Figure 3:
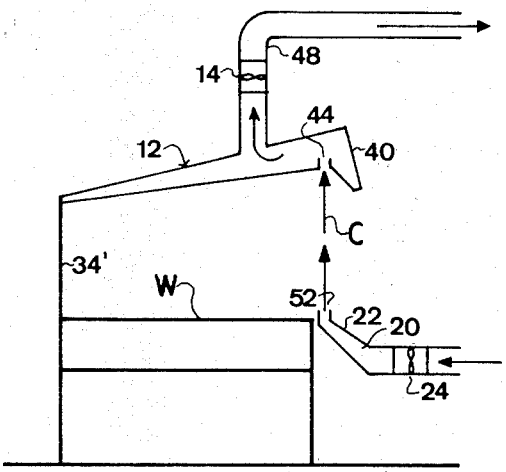
FIG. 3 is a sectional, schematic illustration, similar to FIG. 2, except showing a simplified form of the invention.

In some limited situations, conditions are such that more air can be introduced through nozzle 22 without deleteriously affecting the air curtain. In such situations exhaust air is not returned to the work chamber, but all exhaust air is directed to the atmosphere. A set-up for such a system is illustrated in FIG. 3.

Figure 4:
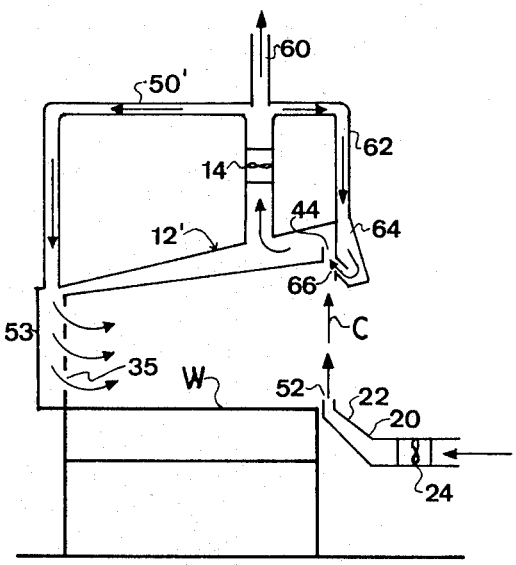
FIG. 4 is a sectional, schematic illustration, similar to FIGS. 2 and 3, except showing another embodiment of the invention.

Another approach is illustrated in FIG. 4, where a portion of the exhaust air is delivered to pollution abatement equipment through duct 60; a portion rerouted to rear plenum 53 through duct 50' in much the same way as in FIGS. 1 and 2; but a portion of the dirty exhaust air is delivered to the forward end of exhaust hood 12' through a third duct 62. A front, upper plenum 64 replaces lip construction 40, 42 and includes an exhaust delivery nozzle 66 which directs an air jet upwardly and inwardly toward exhaust inlet 44. This air jet helps to recondense and reshape the configuration of air curtain C, which would normally tend to spread and billow. In this embodiment, approximately ⅓ of the exhaust air should be directed to the pollution abatement equipment; approximately 40% of the exhaust air should be routed to rear plenum 53; and the remainder to nozzle 64.

Figure 5:
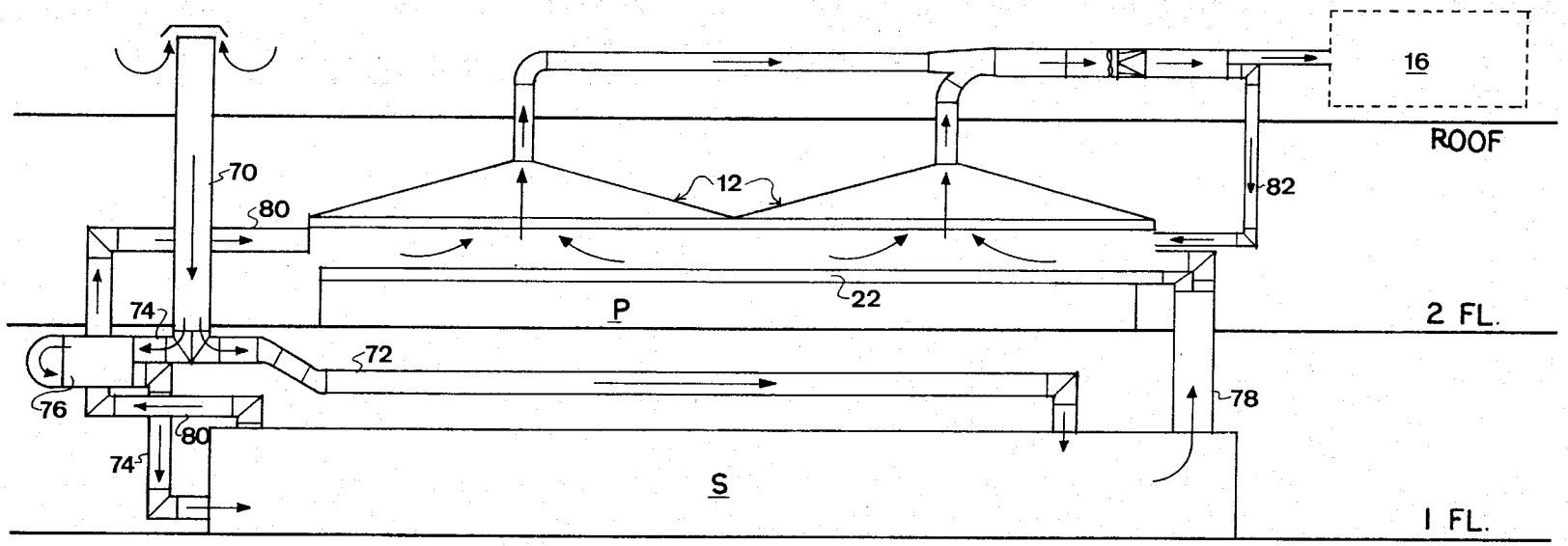
FIG. 5 is a schematic elevational layout, illustrating a second alternate embodiment of the present invention.

Turning now to FIG. 5, in a further possible embodiment, the primary industrial machine P is combined with another or secondary industrial operation S which may be carried out in another place or even on a floor therebeneath as illustrated. In the secondary operation S, a drying operation as illustrated in FIG. 5, the outside air drawn in by intake fan 24 is first introduced to the secondary work process through conduits 70, 72, 74. A heat exchanger 76 in conduit 74 subjects a portion of the incoming air to a heating effect. The clean air exhausted from the drying operation, is then sent through duct 78 directly to be introduced into the primary work area as through outlet 22 in the embodiments of FIGS. 1–4. Another portion of the dirty air leaves the drying operation through duct 80 and is passed through the aforesaid heat exchanger 76 in air-to-air heat exchange relationship with the incoming outside air, so that the incoming air is preheated somewhat before introduction to the dryer. The dirty exhaust air, after leaving the heat exchanger 76, is then introduced to the primary work area, either to form air curtain C, or into the rear of the work chamber through perforated rear wall 34 (FIG. 2), as desired. As in the preferred embodiment a portion of the removed exhaust gases may be recirculated through duct 82 into the work area.

In operation, the invention described hereinabove provides an air curtain or barrier between the open front side of the work area, while confining the other three sides and top thereof. The exhaust gases of all kinds within the enclosed work area thus formed, are then only allowed to escape through the exhaust hood 12. At the same time, the air exhausted from the work area is replaced by fresh air through outlet 22, or by recirculated exhaust air through the perforated rear wall 34, the nozzle 66, or by a combination thereof. In any event, the conditioned air surrounding the industrial machine in the work room is relatively unaffected by the operation of the exhaust hood, so that additional conditioned air does not have to be provided.

Although several preferred embodiments have been described hereinabove, it is apparent that other changes and modifications could be made to the apparatus disclosed hereinafter without departing from the scope of the invention, which should be determined by the following claims.

What is claimed is:

1. In combination with industrial machines of the type having a work table surrounded on two sides, the back, and top by a wall-like enclosure leaving an open front side, and generating a substantial amount of contaminated exhaust gases, an improved ventilating system comprising:

a. an air exhaust means positioned above said enclosure communicating with the air space above said work table along said open front side and including a first fan for removing said exhaust gases from said air space and a gas separating means for cleanup of said contaminated exhaust gases prior to delivery to said outside;

b. an air delivery means including a second fan for drawing in makeup air from a source other than the atmosphere surrounding said work table and introducing said makeup air from a point below the front edge of said work table in a direction toward said exhaust means and including a second fan for drawing in makeup air from a source other than the atmosphere surrounding said work table and;

c. the air from said air delivery means forming a generally vertical air curtain extending between said delivery means and said exhaust means, whereby said exhaust gases are confined within the air space above said work table until withdrawn through said exhaust means, and further whereby said air delivery means provides a source of replacement air to replenish the volume of air withdrawn, so that conditioned air in the work room surrounding said industrial machine is substantially unaffected.

2. The ventilating system according to claim 1 wherein said air exhaust means includes an air outlet extending along a path parallel to and directly above a corresponding air inlet in said air delivery means.

3. The ventilating system according to claim 1 and further including a recirculating means for withdrawing a portion of the removed exhaust gases upstream of said gas separating means and returning said removed portion to said work area to provide additional make-up air for replenishing the volume of air withdrawn.

4. The ventilating system according to claim 3 wherein said enclosure includes a perforated rear wall, said recirculating means so connected to said perforated rear wall as to introduce said removed portion of exhaust gases.

5. The ventilating system according to claim 3 wherein said exhaust means includes an exhaust hood, and further wherein said ventilating system includes another recirculating means for withdrawing a second portion of the removed exhaust gases, an exhaust delivery nozzle at the front end of said exhaust hood directed toward said exhaust means, whereby said second portion of removed exhaust gases is introduced as an air jet to reform and reshape said air curtain to prevent excessive spreading thereof.

6. A method for removing smoke, steam, fumes and such exhaust gases from a work station in a building where an industrial operation of the type generating said gases is being carried on comprising the steps of:

a. enclosing the sides, rear, top and bottom of the work station leaving an open front side;

b. generating a vertical air curtain across said open front side in which the air moves from bottom to top;

c. said air curtain being formed by:

i. providing an exhaust outlet with negative air pressure along the upper edge of said open front side through which said exhaust gases pass and at least a portion thereof are subjected to gas separation and released to the atmosphere outside said building, ii. introducing fresh air from a source other than the air inside the building around said work station toward said outlet through delivery nozzle along the lower edge of said open front side.

7. The method according to claim 6 wherein a portion of the removed exhaust gases are reintroduced through openings in the enclosed sides of said work station and recirculated therethrough; the volume of fresh outside air introduced through the delivery nozzle being substantially one-third the volume of air being exhausted through said exhaust outlet.

8. The method according to claim 7, wherein a second portion of the removed exhaust gases are reintroduced toward said exhaust outlet at a point outside and near the upper end of said air curtain, whereby said second portion reforms and reshapes said air curtain to prevent excessive spreading thereof.

9. An improved ventilating system for manufacturing operations of a type in which two diverse types of machines are utilized, one type of machine having a work table surrounded on two sides, the back and top by a wall-like enclosure leaving an open front side and generating a substantial amount of exhaust gases which must be withdrawn, the other type of machine also generating exhaust gases which must be withdrawn, and both of which requiring replacement air to replenish the air exhausted to withdraw said gases, said system comprising:

a. an air exhaust means positioned above said enclosure communicating with the air space above said work table along said open front side and including a first fan for removing said exhaust gases from said air space;

b. an air delivery means introducing air from a point below the front edge of said work table toward said exhaust means and including a second fan for drawing in air from the outside;

c. the air from said air delivery means forming a generally vertical air curtain extending between said inlet means and said exhaust means, whereby said smoke and fumes are confined within the air space above said work table until withdrawn through said exhaust means, and further whereby said air delivery means provides a source of replacement air to replenish the volume of air withdrawn, so that conditioned air in the work room surrounding said textile machine is substantially unaffected;

d. a recirculating means for removing a portion of the air withdrawn by said air exhaust means and returning said removed portion to said work area to provide additional make-up air for replenishing the volume of air withdrawn;

e. first duct means connecting said other type of machine with said air delivery nozzle of said one type of machine whereby at least part of the exhausted air from said other type of machine provides replacement air to be introduced to the delivery nozzle of said one type of machine;

f. second duct means connecting said other type of machine with a source of fresh outside air.

10. The ventilating system according to claim 9 wherein a third duct means connects said other type of machine with said enclosure to introduce at least another part of said exhausted air from the other type at points other than through said delivery nozzle of said one type of machine.

11. The ventilating system according to claim 10 and further including a heat exchanger connecting said second and third duct means, whereby heated exhaust air from said other type of machine preheats incoming fresh air being delivered to said other type of machine.

12. An improved ventilating system for industrial machines of the type having a work table at which a substantial amount of contaminated exhaust gases are generated, said system comprising:

a. a wall extending along at least one side of said work table and leaving at least one open side;

b. an air exhaust means positioned above and spaced from said work table along the upper edge of said wall, said exhaust means communicating with the air space above said work table along said open side and including a first fan for moving said exhaust gases from said air space;

c. an air delivery means introducing air from a point below the open edges of said work table toward said exhaust means and including a second fan for drawing in air from the outside;

d. the air from said air delivery means forming at least one generally vertical air curtain extending between said air delivery means and said exhaust means, whereby said exhaust gases are confined within the air space above said work table until withdrawn through said exhaust means, and further whereby said air delivery means provides a source of replacement air to replenish the volume of air withdrawn, so that conditioned air in the work room surrounding said industrial machine is substantially unaffected;

e. a recirculating means for withdrawing a portion of the removed exhaust gases and returning said removed portion to said work area to provide additional make-up air for replenishing the volume of air withdrawn.

13. The ventilating system according to claim 12 wherein at least one of said walls is perforated, said recirculating means so connected to said perforated wall as to introduce said removed portion of exhaust gases.

14. The ventilating system according to claim 12 wherein said exhaust means includes an exhaust hood, and further wherein said ventilating system includes a second recirculating means for withdrawing a second portion of the removed exhaust gases, an exhaust delivery nozzle around the edge of said exhaust hood directed toward said exhaust means, whereby said second portion of removed exhaust gases is introduced as an air jet to reform and reshape said curtain to prevent excessive spreading thereof.

* * * * *